US009119762B2

(12) United States Patent
Endo et al.

(10) Patent No.: US 9,119,762 B2
(45) Date of Patent: Sep. 1, 2015

(54) WALKING ASSIST DEVICE, WALKING ASSIST METHOD, WALKING STATE ESTIMATING DEVICE AND WALKING STATE ESTIMATING METHOD

(75) Inventors: Yosuke Endo, Wako (JP); Ken Yasuhara, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 589 days.

(21) Appl. No.: 13/482,510

(22) Filed: May 29, 2012

(65) Prior Publication Data

US 2012/0310122 A1 Dec. 6, 2012

(30) Foreign Application Priority Data

May 30, 2011 (JP) ..... 2011-120201
May 30, 2011 (JP) ..... 2011-120202

(51) Int. Cl.
*A61H 3/00* (2006.01)
*A61H 1/02* (2006.01)

(52) U.S. Cl.
CPC ..... *A61H 1/0244* (2013.01); *A61H 3/00* (2013.01); *A61H 2201/1215* (2013.01); *A61H 2201/1463* (2013.01); *A61H 2201/165* (2013.01); *A61H 2201/5007* (2013.01); *A61H 2201/5069* (2013.01)

(58) Field of Classification Search
CPC ..... A61H 1/00; A61H 1/02; A61H 1/0244; A61H 3/00; A61H 2201/1215; A61H 2201/5069; A61H 2201/165; A61H 2201/5007; A61H 2201/1463
USPC ..... 601/23, 33, 34, 35; 602/16, 19, 23, 24, 602/25, 26; 128/898
See application file for complete search history.

(56) References Cited

U.S. PATENT DOCUMENTS

| | | | | |
|---|---|---|---|---|
| 6,821,229 | B2 * | 11/2004 | Sato et al. | 601/23 |
| 2012/0179075 | A1 * | 7/2012 | Perry et al. | 601/33 |
| 2012/0215140 | A1 * | 8/2012 | Hirata et al. | 601/35 |

FOREIGN PATENT DOCUMENTS

| | | |
|---|---|---|
| JP | 10-113343 | 5/1998 |
| JP | 2004-358229 | 12/2004 |
| JP | 2005-342254 | 12/2005 |
| JP | 2009-095426 | 5/2009 |
| JP | 2009-095427 | 5/2009 |
| WO | 2011/049171 | 4/2011 |

* cited by examiner

*Primary Examiner* — Quang D Thanh
(74) *Attorney, Agent, or Firm* — Rankin, Hill & Clark LLP

(57) ABSTRACT

A walking assist device evaluates the degree of asymmetry between a left motion oscillator, which is a waveform signal indicative of the time-dependent change form of an output of a left hip joint angle sensor, and a right motion oscillator, which is a waveform signal indicative of the time-dependent change form of an output of a right hip joint angle sensor. In order to reduce the degree of asymmetry, the value of at least one of a left bending coefficient, a left stretching coefficient, a right bending coefficient, and a right stretching coefficient is adjusted.

13 Claims, 10 Drawing Sheets

WALKING ASSIST DEVICE, WALKING ASSIST METHOD, WALKING STATE ESTIMATING DEVICE AND WALKING STATE ESTIMATING METHOD

BACKGROUND OF THE INVENTION

1. Field of the Invention

The present invention relates to a device and a method for assisting the walking motion of a human being and a device and a method for estimating the walking state of a human being.

2. Description of the Related Art

There have been proposed techniques for adjusting the values of coefficients included in a simultaneous differential equation of a plurality of state variables so as to set the length of stride or the like of a human being, who is a user, to a desired value in a walking assist device which generates an output waveform signal for controlling the operation of an actuator by using a model defined by the simultaneous differential equation (refer to Japanese Patent Publications No. 4234765 and No. 4271712).

However, in a situation wherein the right and left motion patterns of a human being are uneven because of, for example, a deteriorated physical function on the right or the left side of the human being, an attempt to always match the length of stride or the like to a desired value thereof may further increase the unevenness rather than correcting the unevenness.

SUMMARY OF THE INVENTION

An object of the present invention, therefore, is to provide a device capable of assisting a human being with his or her walking motion while maintaining even right and left motion patterns of the human being.

The present invention relates to a device which has a first attachment to be attached to the upper body of a human being, a pair of second attachments, each of which is to be attached to the right and left thighs, respectively, of the human being, a pair of actuators, a right hip joint angle sensor adapted to output a signal based on a right hip joint angle of the human being and a left hip joint angle sensor adapted to output a signal based on a left hip joint angle of the human being, and a control unit adapted to control the operation of each of the pair of actuators on the basis of at least output signals of the right hip joint angle sensor and the left hip joint angle sensor, wherein each of the pair of the second attachments is moved relative to the first attachment by operating each of the pair of the actuators, thereby assisting the walking motion of the human being, which involves the relative cyclic motions of the right and left thighs with respect to the upper body.

In a walking assist device according to a first aspect of the present invention, the control unit is adapted to control the magnitude of the movement amplitudes of the pair of the actuators for assisting each of the bending motion and the stretching motion of the right thigh and the bending motion and the stretching motion of the left thigh of the human being on the basis of the magnitude of the value of each of a right bending coefficient, a right stretching coefficient, a left bending coefficient and a left stretching coefficient, and includes an asymmetry evaluating unit adapted to evaluate the degree of asymmetry between a right motion oscillator (oscillation signal), which is a waveform signal indicating a time-dependent change form of the output of the right hip joint angle sensor, and a left motion oscillator, which is a waveform signal indicating a time-dependent change form of the output of the left hip joint angle sensor, and an adjusting unit adapted to adjust the value of at least one of the right bending coefficient, the right stretching coefficient, the left bending coefficient and the left stretching coefficient so as to reduce the degree of asymmetry evaluated by the asymmetry evaluating unit.

The walking assist device according to the first aspect of the present invention makes it possible to reduce the degree of asymmetry, which indicates the degree of unevenness of the right and left motion patterns of a human being in the form of the degree of asymmetry between the right and left motion oscillators. This allows the walking motion of the human being to be assisted while ensuring the evenness of the right and left motion patterns of the human being.

Preferably, the adjusting unit is adapted to adjust the value of at least one of the right bending coefficient, the right stretching coefficient, the left bending coefficient and the left stretching coefficient such that the left bending coefficient and the right stretching coefficient share the same value and the right bending coefficient and the left stretching coefficient share the same value.

Preferably, the adjusting unit is adapted to adjust the value of at least one of the right bending coefficient, the right stretching coefficient, the left bending coefficient and the left stretching coefficient on the basis of a correction amount defined by an increasing function having the degree of asymmetry as a variable.

Preferably, the control unit is adapted to control the levels of the operating frequencies of the actuators for assisting the motions of the individual right and left thighs of the human being on the basis of the magnitudes of the values of a right time constant and a left time constant, and the adjusting unit is adapted to adjust the values of the right time constant and the left time constant on the basis of the waveform signals indicating the time-dependent change forms of the right and left hip joint angles of the human being obtained from the outputs of the right hip joint angle sensor and the left hip joint angle sensor, respectively.

Preferably, the walking assist device includes: a window processor adapted to carry out window processing for windowing a differential oscillator, which is a waveform signal obtained by sampling the difference between the right and left hip joint angles of the human being over a specified period of time on the basis of the output signals of right hip joint angle sensor and the left hip joint angle sensor, respectively; a frequency analysis processor adapted to carry out a frequency analysis on the windowed differential oscillator thereby to acquire a power spectrum; and a spectrum analysis processor adapted to determine a basic frequency exhibiting a peak which is as high as or higher than a threshold value and which is positioned in a lowest frequency band of the power spectrum, wherein the adjusting unit adjusts the values of the right time constant and the left time constant such that the values are proportional to an inverse number of the basic frequency.

Preferably, the difference in one of a bending amplitude indicative of the amplitude of a bending motion of a thigh relative to the upper body of the human being, a stretching amplitude indicative of the amplitude of a stretching motion of a thigh of the human being, and a total amplified indicative of the sum of the bending amplitude and the stretching amplitude between the right motion oscillator and the left motion oscillator, or the mean value of the differences over a plurality of cycles is evaluated as the degree of asymmetry.

Preferably, the control unit is provided with a state oscillator generator adapted to supply the right motion oscillator and the left motion oscillator as input waveform signals to a state oscillator model, which is defined by a simultaneous differential equation of a plurality of state variables indicating a bending motion state and a stretching motion state of each of the thighs of the human being, which is expressed by the time-dependent change form of a solution of the simultaneous differential equation determined by the input waveform signals, and which generates output waveform signals, thereby to generate, as the output waveform signals, the right bending oscillator, the right stretching oscillator, the left bending oscillator and the left stretching oscillator, which change according to the amplitudes based on the values of the right bending coefficient, the right stretching coefficient, the left bending coefficient, and the left stretching coefficient, respectively; and a control oscillator generator adapted to generate a right control oscillator serving as a control command signal for the actuator on the right side by combining the right bending oscillator and the right stretching oscillator and to generate a left control oscillator serving as a control command signal for the actuator on the left side by combining the left bending oscillator and the left stretching oscillator.

A walking assist device according to a second aspect of the present invention further includes a walking state estimating device which determines a basic frequency by using a differential oscillator, which is a waveform signal obtained by sampling the difference between the right and left hip joint angles or shoulder joint angles of the human being through the right hip joint angle sensor and the left hip joint angle sensor over a specified period of time, wherein the control unit is adapted to control cyclic operations of the actuators according to a cycle established on the basis of the basic frequency determined by the walking state estimating device, the walking state estimating device includes a window processor adapted to execute window processing for windowing the differential oscillator, a frequency analysis processor adapted to acquire a power spectrum by carrying out a frequency analysis on the windowed differential oscillator, and a spectrum analysis processor adapted to determine a frequency exhibiting a peak which has a height equal to or greater than a threshold value and which is positioned in a lowest frequency band of the power spectrum, as the basic frequency, and the window processor is adapted to set the width of the window for a current cycle according to a decreasing function, which has the basic frequency as a variable, on the basis of a basic frequency in a previous cycle determined by the spectrum analysis processor.

The walking assist device according the second aspect of the present invention assists the cyclic motion of each leg of a human being by the cyclic motions of the actuators. At this time, the operation cycles of the actuators are determined on the basis of the basic frequency indicative of an estimated walking state of the human being, which is obtained by the walking state estimating device in accordance with the present invention. This makes it possible to assist the walking motion of the human being at appropriate cycles according to the walking state of the human being, which is estimated with high accuracy on the basis of a basic frequency as described above.

The walking state estimating device according to the present invention includes: a window processor adapted to execute window processing for windowing the differential oscillator, which is a waveform signal obtained by sampling, over a specified period of time, the differences between the right and left hip joint angles or shoulder joint angles of the human being while he or she is walking; a frequency analysis processor adapted to acquire a power spectrum by carrying out a frequency analysis on the windowed differential oscillator; and a spectrum analysis processor adapted to determine a basic frequency having a peak which has a height equal to or greater than a threshold value and which is positioned in a lowest frequency band of the power spectrum, wherein the window processor is adapted to set the width of the window for a current cycle according to a decreasing function, which has the basic frequency as a variable, on the basis of the basic frequency of a previous cycle determined by the spectrum analysis processor.

According to the walking state estimating device in accordance with the present invention, the difference between the right and the left hip joint angles or shoulder joint angles of a human being is sampled to obtain a differential oscillator serving as a waveform signal, and a power spectrum is obtained from the differential oscillator. This arrangement makes it possible to estimate the walking state of the human being with high accuracy according to the specific rule in which the basic frequency is referred to. The basic frequency has a single peak which is as high as or higher than a threshold value and which is positioned in a lowest frequency band of a power spectrum, regardless of the magnitude of the asymmetry of the right and left physical motions of the human being.

The width of the current window to be applied to a differential oscillator in a current specified period of time is set to be smaller as a previous basic frequency is higher, whereas the width of the current window is set to be larger as the previous basic frequency is lower. This makes it possible to extract a differential oscillator having a just sufficient, appropriate width for a frequency analysis in estimating a current basic frequency.

Preferably, the window processor is adapted to remove high-frequency components exceeding a first specified frequency from the differential oscillator by downsampling the differential oscillator before carrying out the window processing.

Preferably, the window processor is adapted to remove low-frequency components that are equal to or lower than a second specified frequency from the differential oscillator by passing the differential oscillator through a high-pass filter before carrying out the window processing.

DESCRIPTION OF THE PREFERRED EMBODIMENTS

First Embodiment

Figure 1:
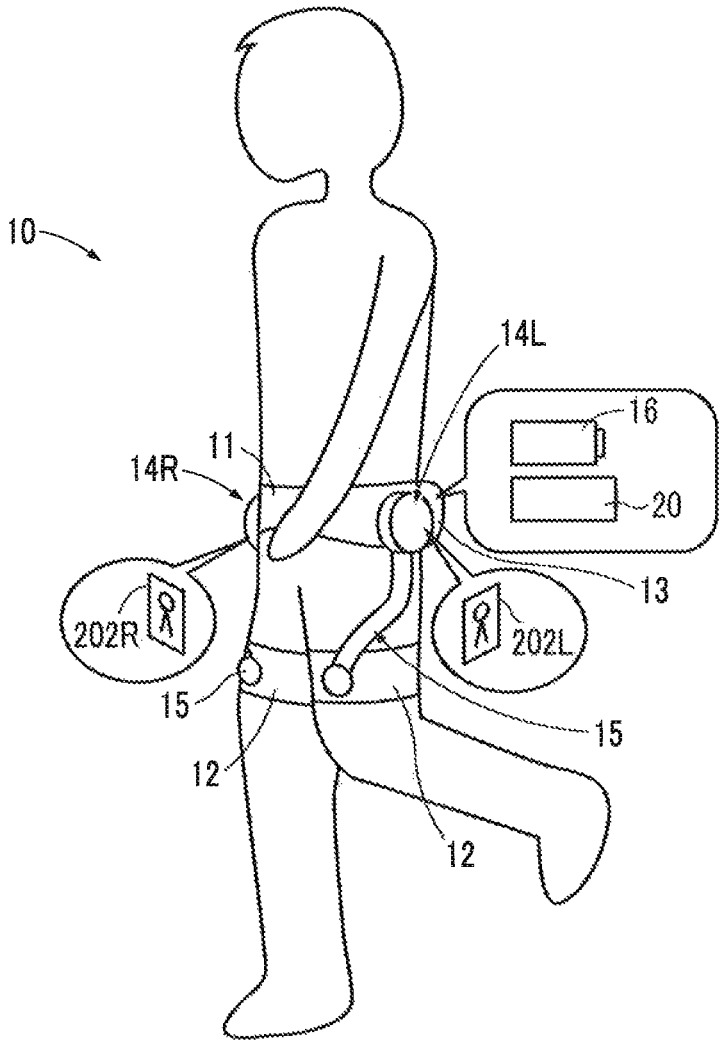
FIG. 1 is an explanatory diagram illustrating the basic configuration of a walking assist device in accordance with the present invention.

In the following description, reference characters "L" and "R" will be used to distinguish between the right and the left of legs and the like. The reference characters, however, will be omitted when there is no need to distinguish between the right and the left or when expressing vectors that have right and left components. Further, signs "+" and "−" will be used to distinguish between the bending motion (a forward motion) and the stretching motion (a backward motion) of each thigh relative to an upper body.

A walking assist device 10 illustrated in FIG. 1 as a first embodiment of the present invention is provided with a first attachment 11, a pair of right and left second attachments 12, a pair of right and left actuators 14, a battery 16, a controller 20, and hip joint angle sensors 202.

The first attachment 11 is wrapped around the upper body or the waist (a first body portion) of a human being or a user. In the first attachment 11, a rear portion thereof that comes in contact with at least the back of the human being is formed of a rigid material, such as a lightweight alloy, a hard resin or a carbon fiber, while the rest thereof is formed of a soft material, such as a fabric.

The second attachments 12 are formed of a soft material, such as a fabric, and wrapped around the thighs (second body portions) of the human being. The second attachment 12 may be provided only on the right or the left thigh rather than on both right and left thighs.

Each of the actuators 14 is composed of an electric motor, and as necessary, composed of one or both of a speed reducer and a compliance mechanism in addition to the motor. The actuators 14 are connected to the first attachment 11 such that they are disposed on the right and the left sides of the upper body when the first attachment 11 is installed to the upper body. The actuators 14 are connected to the second attachments 12 installed to the thighs through the intermediary of linking members 15 made of a rigid material, such as a lightweight alloy, a hard resin or a carbon fiber.

Thus, as the actuators 14 are operated, forces are applied to the upper body and the thighs so as to assist the relative motions of the upper body and the thighs. The relative motions of the upper body and the thighs include a longitudinal motion of the thigh of a leg off a floor with respect to the upper body and also a longitudinal motion of the upper body with respect to a leg on the floor.

The battery 16 housed together with the controller 20 in a case 13 attached to the rear portion of the first attachment 11 supplies electric power to the actuators 14, the controller 20 and the like. The position of each of the battery 16 and the controller 20 or the position of the case 13 accommodating the battery 16 and the controller 20 may be changed, as necessary.

The hip joint angle sensors 202 composed of rotary encoders disposed on both the right and left sides of the waist of the human being issue signals based on hip joint angles. The hip joint angles are defined such that they take positive values when a thigh is located in front of a basic frontal plane, while they take negative values when the thigh is behind the basic frontal plane.

The controller 20 is constituted of a computer, which is composed of a CPU, a ROM, a RAM, a signal input circuit, a signal output circuit and the like, and software stored in a memory or storage of the computer. The controller 20 regulates the power supplied from the battery 16 to the actuators 14 and also controls the operations of the actuators 14.

Configuration of the Controller

First Embodiment

Figure 2:
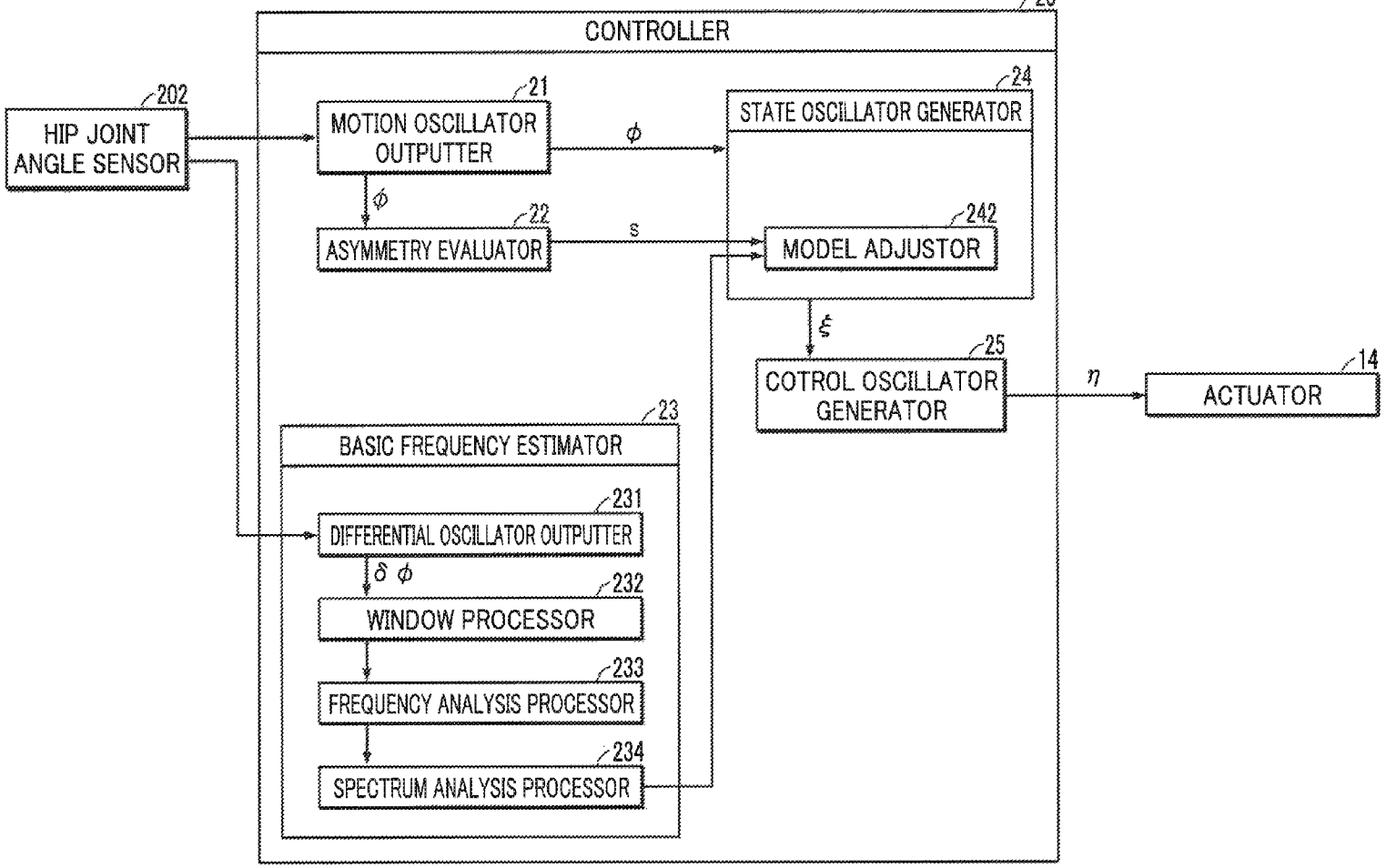
FIG. 2 is a block diagram of a control unit of the walking assist device (a first embodiment)

As illustrated in FIG. 2, the controller 20 in the first embodiment of the present invention has a motion oscillator outputter 21, which carries out or functions to implement arithmetic processing to be discussed hereinafter, an asymmetry evaluator 22, a basic frequency estimator 23, a state oscillator generator 24, a model adjustor 242 (corresponding to an adjusting unit in the present invention), and a control oscillator generator 25. The basic frequency estimator 23 has a differential oscillator outputter 231, a window processor 232, a frequency analysis processor 233, and a spectrum analysis processor 234.

Each of the constituent units of the controller 20 is composed of an arithmetic processor that reads the program stored in the storage and carries out arithmetic processing, for which the processor is responsible, according to the program. The constituent units may alternatively share the same arithmetic processor or may alternatively be formed of physically separate arithmetic processors. For example, the basic frequency estimator 23 may be constituted of an arithmetic processor that is separate from the remaining constituent units.

When an operation switch (not shown) is turned on and the power is supplied from the battery 16 to the controller 20, the controller 20 is enabled to implement the functions.

Functions of the Walking Assist Device

First Embodiment

Figure 3:
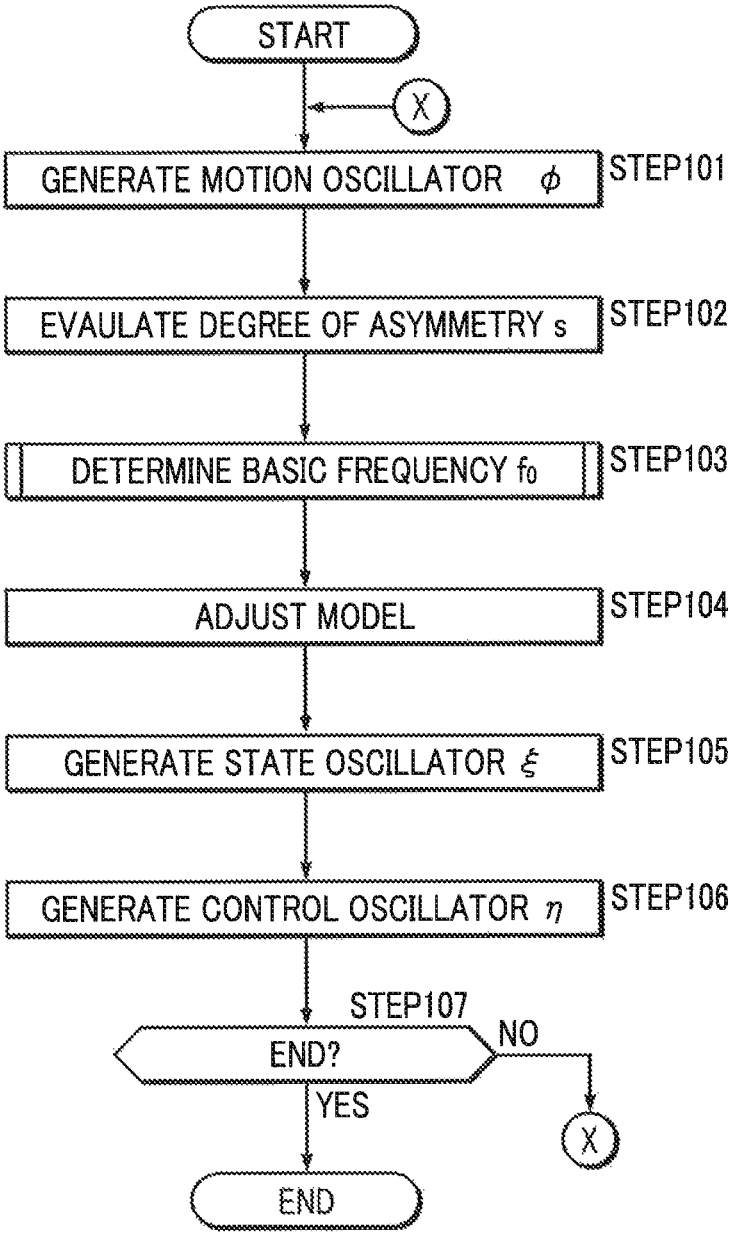
FIG. 3 is a flowchart illustrating a control method of the walking assist device (the first embodiment)

Based on the outputs of the hip joint angle sensors 202, the motion oscillator outputter 21 generates waveform signals, which indicate the time-dependent changes of the right and left hip joint angles of a human being, as a motion oscillator $\phi=(\phi_L, \phi_R)$ in STEP101 of FIG. 3. The symbol "$\phi_L$" denotes a left motion oscillator, while the symbol "$\phi_R$" denotes a right motion oscillator.

Subsequently, the asymmetry evaluator 22 evaluates the degree of asymmetry s of the right motion oscillator $\phi_R$ and the left motion oscillator $\phi_L$ in STEP102 of FIG. 3. For example, as indicated by the one-dot chain line and the two-dot chain line, respectively, in FIG. 4, the case where the right motion oscillator $\phi_R$ and the left motion oscillator $\phi_L$ change will be discussed.

If the polarity of the left motion oscillator $\phi_L$ is positive, then it means that the left thigh is bending relative to the upper body, and if the polarity of the left motion oscillator $\phi_L$ is negative, then it means that the left thigh is stretching relative to the upper body. A bending amplitude $|\phi_{L+}|$ indicating the absolute value of a maximum value (positive value) of the left motion oscillator $\phi_L$ in each cycle corresponds to the angle of the left hip joint at the point when the left thigh is at its maximum bend relative to the upper body. A stretching amplitude $|\phi_{L-}|$ indicating the absolute value of a minimum value (negative value) of the left motion oscillator $\phi_L$ in each cycle corresponds to the angle of the left hip joint when the left thigh is at its maximum stretch relative to the upper body.

Similarly, if the polarity of the right motion oscillator $\phi_R$ is positive, then it means that the right thigh is bending relative to the upper body, and if the polarity of the right motion oscillator $\phi_R$ is negative, then it means that the right thigh is stretching relative to the upper body. A bending amplitude indicating the absolute value of a maximum value (positive value) of the right motion oscillator $\phi_R$ in each cycle corresponds to the angle of the right hip joint at the point when the right thigh is at its maximum bend relative to the upper body. A stretching amplitude $|\phi_{R-}|$ indicating the absolute value of a minimum value (negative value) of the right motion oscillator $\phi_R$ in each cycle corresponds to the angle of the right hip joint when the right thigh is at its maximum stretch relative to the upper body.

For example, the difference between a left total amplitude $|\phi_L|$ denoting the sum of a left bending amplitude $|\phi_{L+}|$ and a left stretching amplitude $|\phi_{L-}|$ and a right total amplitude $|\phi_R|$ denoting the sum of a right bending amplitude $|\phi_{R+}|$ and a right stretching amplitude $|\phi_{R-}|$, the difference being denoted by $|\phi_L|-|\phi_R|$, or the mean value of the differences over a plurality of cycles is evaluated as the degree of asymmetry s. In the situation illustrated in FIG. 4, the right total amplitude $|\phi_R|$ is larger than the left total amplitude $|\phi_L|$, so that the degree of asymmetry s will take a negative value.

Further, in STEP103 of FIG. 3, the basic frequency estimator 23 carries out the arithmetic processing, which will be discussed hereinafter, to estimate a basic frequency $f_0$ corresponding to the inverse number of the walking cycle of a human being.

Subsequently, in STEP104 of FIG. 3, the model adjustor 242 adjusts the value of a coefficient, which defines a state oscillator model, on the basis of the degree of asymmetry s and the basic frequency $f_0$ (more accurately, a corrected basic frequency $f_{0_d}$, which will be described hereinafter).

The state oscillator model is defined by a plurality of state variables $u_i$ (i=L+, L−, R+ and R−) indicative of the bending motion state and the stretching motion state of each thigh and a simultaneous differential equation (010) of a self-restraining factor $v_i$ for expressing the adaptability of each of the bending motion state and the stretching motion state of each thigh.

$$\tau_{1L}(du_{L+}/dt)=c_{L+}-u_{L+}+w_{L+/L-}\xi_{L-}+w_{L+/R+}\xi_{R+}-\lambda_L v_{L+}+f_1(\omega_L)+f_2(\omega_L)K_{\phi L},$$

$$\tau_{1L}(du_{L-}/dt)=c_{L-}-u_{L-}+w_{L-/L+}\xi_{L+}+w_{L-/R-}\xi_{R-}-\lambda_L v_{L-}+f_1(\omega_L)+f_2(\omega_L)K_{\phi L},$$

$$\tau_{1R}(du_{R+}/dt)=c_{R+}-u_{R+}+w_{R+/L+}\xi_{L-}+w_{R+/R-}\xi_{R+}-\lambda_R v_{R+}+f_1(\omega_R)+f_2(\omega_R)K_{\phi R},$$

$$\tau_{1R}(du_{R-}/dt)=c_{R-}-u_{R-}+w_{R-/L-}\xi_{L-}+w_{R-/R+}\xi_{R+}-\lambda_R v_{R-}+f_1(\omega_R)+f_2(\omega_R)K_{\phi R},$$

$$\tau_{2i}(dv_i/dt)=-v_i+\xi_i\ (i=L+,L-,R+,R-),$$

$$\xi_i=H(u_i-u_{th})=0(u_i<u_{th}) \tag{010}$$

"$c_{L+}$" denotes a left bending coefficient that determines the magnitude of the amplitude of a state variable $u_{L+}$ indicative of the bending motion state of the left thigh; "$c_{L-}$" denotes a left stretching coefficient that determines the magnitude of the amplitude of a state variable $u_{L-}$ indicative of the stretching motion state of the left thigh; "$c_{R+}$" denotes a right bending coefficient that determines the magnitude of the amplitude of a state variable $u_{R+}$ indicative of the bending motion state of the right thigh; and "$c_{R-}$" denotes a right stretching coefficient that determines the magnitude of the amplitude of a state variable $u_{R-}$ indicative of the stretching motion state of the right thigh.

"$\tau_{1L}$" denotes a first left time constant, which determines the levels of the frequencies of the state variables $u_{L+}$ and $u_{L-}$, while "$\tau_{1R}$" denotes a first right time constant, which determines the levels of the frequencies of the state variables $u_{R+}$ and $u_{R-}$. The first left time constant $\tau_{1L}$ and the first right time constant $\tau_{IR}$ may share the same value or take different values. "$\tau_{2i}$" denotes a second time constant, which determines the level of the frequency of the restraining factor $v_i$. The second time constant $\tau_{2i}$ may share the same value or take different values. For example, the second left bending time constant $\tau_{2L+}$ and the second left stretching time constant $\tau_{2L-}$ may share the same value, the second right bending time constant $\tau_{2R+}$ and the second right stretching time constant $\tau_{2R-}$ may share the same value, while the second left bending time constant $\tau_{2L+}$ and the second right bending time constant $\tau_{2R+}$ may take different values.

"$w_{i/j}$" denotes the coefficient of correlation, which takes a negative value indicative of the correlation of the state variables $u_i$ and $u_j$; "$\lambda_L$" and "$\lambda_R$" denote habituation coefficients; and "K" denotes a feedback coefficient based on the motion oscillator $\phi$.

"ω" denotes a specific angular velocity determined by the length of the walking cycle of a human being. The specific angular velocity ω is set to, for example, a value obtained by multiplying the basic frequency $f_0$ (or the corrected basic frequency $f_{0_d}$) by 2π. The specific angular velocity ω includes a left component $\omega_L$ and a right component $\omega_R$; however, the basic frequency $f_0$ does not require the discrimination between right and left, so that $\omega_L$ and $\omega_R$ have the same value.

"$f_1$" denotes a linear function of the specific angular velocity ω defined by expression (011) by using a positive coefficient c.

$$f_1(\omega)=c\omega \tag{011}$$

"$f_2$" denotes a quadratic function of the specific angular velocity w defined by expression (012) by using coefficients $c_0$, $c_1$ and $c_2$.

$$f_2(\omega)=c_0+c_1\omega+c_2\omega^2 \tag{012}$$

To be more specific, the model adjustor 242 uses the degree of asymmetry s as a variable and sets the value of each state coefficient $c_i$ according to a relational expression (021) on the basis of a correction amount defined by an increasing function f(s) in a standard definition area of at least the degree of asymmetry s.

$$c_{L+}=c_{R-}=\chi_1+\chi_2 f(-s),$$

$$c_{L-}=c_{R+}=\chi_1+\chi_2 f(s) \tag{021}$$

The coefficient $\chi_1$ (>0) denotes a coefficient for determining the length of stride or the walking rate of a human being applied when the walking assist device 10 is operated. The walking motion is assisted such that the length of stride of the human being increases as the set value of the coefficient $\chi_1$ is increased, while the length of stride of the human being decreases as the set value of the coefficient $\chi_1$ is decreased.

The coefficient $\chi_2$ (>0) denotes a gain coefficient separately indicating the step amount of correction or a correction velocity of each of the right and the left length of stride to reduce the degree of asymmetry s. The walking motion is assisted such that the length of stride of a human being is changed more promptly as the value of the coefficient $\chi_2$ is set to be larger, while the walking motion is assisted such that the length of stride of the human being is changed more slowly as the value of the coefficient $\chi_2$ is set to be smaller.

The increasing function f(s) is defined according to, for example, a relational expression (022).

$$f(s)=s/\{1+\exp(-s/D)\} \tag{022}$$

Figure 5:
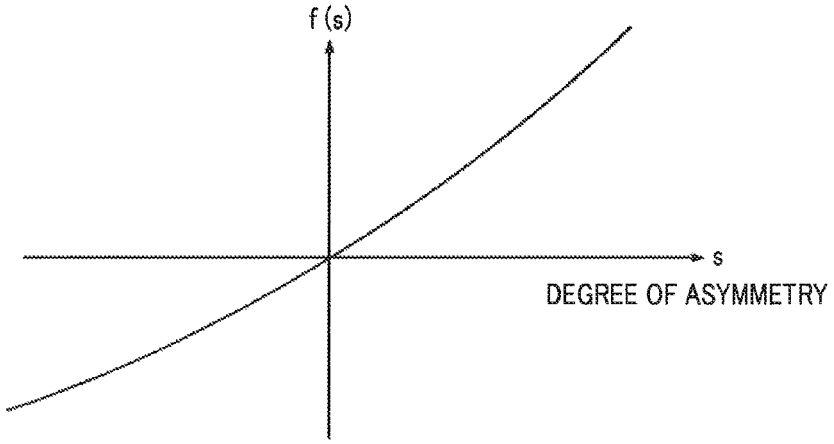
FIGS. 5(*a*) to FIG. 5(*c*) are diagrams illustrating a model adjusting method based on evaluation results of the degrees of asymmetry.
Figure 5:
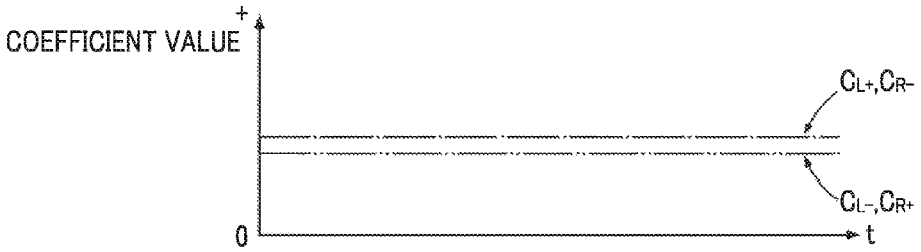
Figure 5:
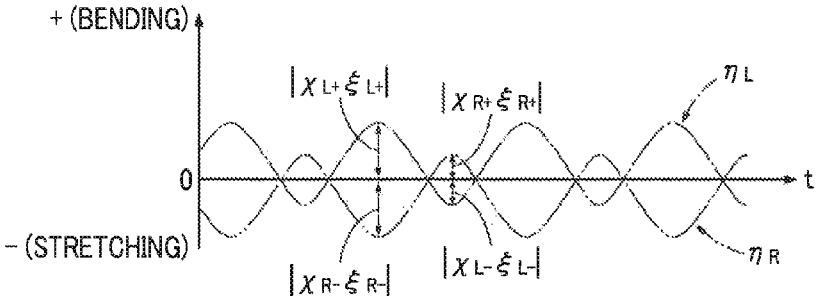

The function f(s) defined by the relational expression (022) exhibits the variation characteristic illustrated in FIG. 5(*a*). Hence, even if the degree of asymmetry s takes a positive value, an adjustment is made such that the values of the left bending coefficient $c_{L+}$ and the right stretching coefficient $c_{R-}$ decrease, while the values of the left stretching coefficient $c_{L-}$ and the right bending coefficient $c_{R+}$ increase when the degree of asymmetry s takes a positive value and the absolute value thereof increases (refer to relational expression (021)). Further, an adjustment is made such that the values of the left bending coefficient $c_{L+}$ and the right stretching coefficient $c_{R-}$ increase, while the values of the left stretching coefficient $c_{L-}$ and the right bending coefficient $c_{R-}$ decrease when the degree of asymmetry s takes a negative value and the absolute value thereof increases.

Figure 4:
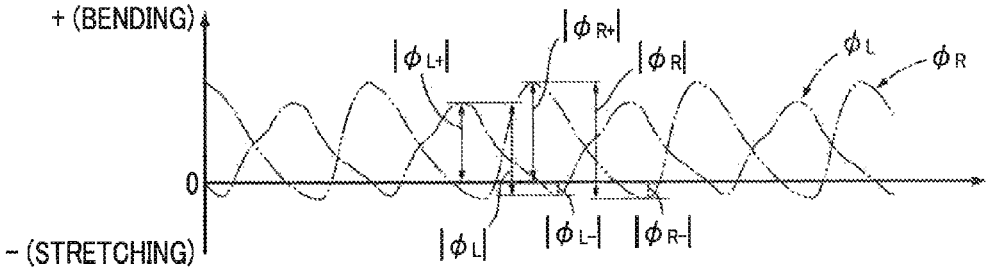
FIG. 4 is a diagram illustrating asymmetry.

In the situation illustrated in FIG. 4, the value of the degree of asymmetry s is negative, as described above. Therefore, the values of the respective coefficients are adjusted such that the values of the left bending coefficient $c_{L-}$ and the right stretching coefficient $c_{R-}$ become relatively larger than the values of the left stretching coefficient $c_{L-}$ and the right bending coefficient $c_{R+}$, as illustrated in FIG. 5(*b*).

The model adjustor 242 adjusts or sets the value of the first time constant $\tau_1$ according to relational expression (023) on the basis of the corrected basic frequency $f_{0_d}$ and a coefficient $\alpha_0$ (>0) and $\beta_0$ (>0).

$$\tau_1=\alpha_0/f_{0_d}+\beta_0 \tag{023}$$

The model adjustor 242 adjusts or sets the value of the second time constant $\tau_2$ according to relational expression (024) on the basis of the first time constant $\tau_1$ and a positive coefficient $\gamma_0$ (e.g., "2").

$$\tau_2=\gamma_0\tau_1 \tag{024}$$

Figure 6:
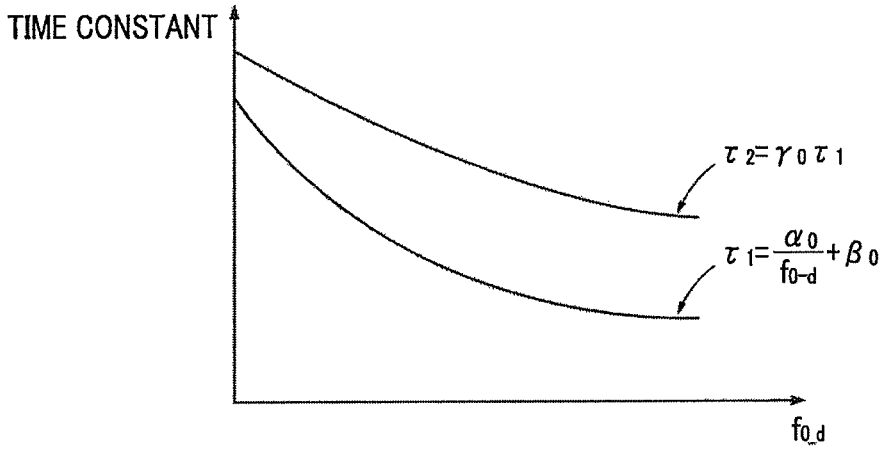
FIG. 6 is a diagram illustrating a method for setting time constants.

The function defined by relational expression (023) exhibits the variation characteristic illustrated in FIG. 6. Hence, an adjustment is made such that the values of the first time constant $\tau_1$ and the second time constant $\tau_2$ decrease as the corrected basic frequency $f_{0_d}$ becomes higher, i.e., as the walking cycle shortens. Further, an adjustment is made such that the values of the first time constant $\tau_1$ and the second time constant $\tau_2$ increase as the corrected basic frequency $f_{0_d}$ becomes lower, i.e., as the walking cycle becomes longer.

Subsequently, the state oscillator generator 24 supplies, as an input waveform signal, a motion oscillator output from the motion oscillator outputter 21 to the state oscillator model defined by simultaneous differential equation (010) thereby to generate a state oscillator $\xi$ as an output waveform signal in STEP105 of FIG. 3. The state oscillator $\xi$ includes a left bending oscillator $\xi_{L+}$, the left stretching oscillator $\xi_{L-}$, the right bending oscillator $\xi_{R+}$, and the right stretching oscillator $\xi_{R-}$.

In the period from the start of the operation of the walking assist device 10 until the motion oscillators necessary for evaluating the degree of asymmetry s are obtained, the coefficients $c_i$ are set to predetermined initial values. Similarly, in the period from the start of the operation of the walking assist device 10 until the differential oscillators (to be discussed hereinafter) required for estimating the basic frequency $f_0$ are obtained, the specific angular velocity $\omega$ is set to a predetermined initial value.

A motion oscillator $\phi$ to be input to the state oscillator model may be the same as or different from the motion oscillator $\phi$ used for evaluating the degree of asymmetry s. For example, as the motion oscillator $\phi$ to be input to the state oscillator model, a waveform signal indicating the time-dependent change forms of a pair of right and left variables, which change at a cycle closely related to the walking cycle of a human being, such as the right and left hip joint angular velocities, the right and left shoulder joint angles or the right and left shoulder joint angular velocities, may be adopted in place of the waveform signal indicating the time-dependent change forms of the right and left hip joint angles of the human being. As with the hip joint angles, the shoulder joint angles can be measured by a pair of shoulder joint angle sensors, which are composed of rotary encoders and which are disposed on the outer sides of the right and left shoulders of the human being, on the basis of the outputs of the shoulder joint angle sensors.

If the value of the state variable $u_i$ is below a threshold value $u_{th}$, then the state oscillator $\xi_i$ is zero, and if the value of the state variable $u_i$ is the threshold value $u_{th}$ or more, then the state oscillator $\xi_i$ takes the value of the $u_i$ (refer to the simultaneous differential equation (010)). Thus, as the state variable $u_{L+}$, which denotes the bending motion state of the left thigh, increases, the amplitude of the left bending oscillator $\xi_{L+}$ becomes larger than the amplitude of the left stretching oscillator $\xi_{L-}$. Further, as the state variable $u_{R+}$, which denotes the bending motion state of the right thigh, increases, the amplitude of the right bending oscillator $\xi_{R+}$ becomes larger than the amplitude of the right stretching oscillator $\xi_{R-}$.

Further, as the state variable $u_{L-}$, which denotes the stretching motion state of the left thigh, increases, the amplitude of the left stretching oscillator $\xi_{L-}$ becomes larger than the amplitude of the left bending oscillator $\xi_{L+}$. Further, as the state variable $u_{R-}$, which denotes the stretching motion state of the right thigh, increases, the amplitude of the right stretching oscillator $\xi_{R-}$ becomes larger than the amplitude of the right bending oscillator $\xi_{R+}$.

As a result, the left bending oscillator $\xi_{L-}$ and the left stretching oscillator $\xi_{L-}$, which change according to the amplitudes based on the values of the left bending coefficient $c_{L+}$ and the left stretching coefficient $c_{L-}$, respectively, and the frequency based on the value of the first left time constant $\tau_{1L}$ included in simultaneous differential equation (010), are generated. In addition, the right bending oscillator $\xi_{R+}$ and the right stretching oscillator $\xi_{R-}$, which change according to the amplitudes based on the values of the right bending coefficient $c_{R+}$ and the right stretching coefficient $c_{R-}$ and the frequency based on the value of the first right time constant $\tau_{1R}$ included in simultaneous differential equation (010), are generated.

Then, the control oscillator generator 25 sets a control oscillator $\eta=(\eta_L, \eta_R)$ according to relational expression (040) on the basis of the state oscillator $\xi$ in STEP106 of FIG. 3.

$$\eta_L=\chi_{L+}\xi_{L+}-\chi_{L-}\xi_{L-},$$

$$\eta_R=\chi_{R+}\xi_{R+}-\chi_{R-}\xi_{R-} \tag{040}$$

The left control oscillator $\eta_L$ is calculated as the difference between the product of the left bending oscillator $\xi_{L+}$ and the coefficient $\chi_{L+}$ and the product of the left stretching oscillator $\xi_{L-}$ and the coefficient $\xi_{L-}$. The right control oscillator $\eta_R$ is calculated as the difference between the product of the right bending oscillator $\xi_{R+}$ and the coefficient $\chi_{R-}$ and the product of the right stretching oscillator $\xi_{R-}$ and the coefficient $\chi_{R-}$. The four coefficients $\chi_i$ may be set to the same value.

In the situation wherein the length of stride of the left leg is smaller than the length of stride of the right leg as illustrated in FIG. 4, the value of the left bending coefficient $c_{L+}$ is set to be larger than the value of the right bending coefficient $c_{R+}$ and the value of the right stretching coefficient $c_{R-}$ is set to be larger than the left stretching coefficient $c_{L-}$, as illustrated in FIG. 5(*b*). Thus, the bending amplitude $|\chi_{L+}\xi_{L+}|$ of the left control oscillator $\eta_L$ becomes larger than the bending amplitude $|\chi_{R+}\xi_{R+}|$ of the right control oscillator $\eta_R$, as illustrated in FIG. 5(*c*). Further, the stretching amplitude $|\chi_{L-}\xi_{L-}|$ of the left control oscillator $\eta_L$ becomes smaller than the stretching amplitude $|\chi_{R-}\xi_{R-}|$ of the right control oscillator $\eta_R$.

Subsequently, the controller 20 adjusts currents $I=(I_L, I_R)$ supplied to the right and left actuators 14L and 14R, respectively, from the battery 16 on the basis of the control oscillators $\eta$. This adjusts the forces that assist the bending motions and the stretching motions of the right and left thighs relative to the upper body through the intermediary of the first attachment 11 and the second attachments 12, or rotational forces $F=(F_L, F_R)$ about the hip joints. The assist force F is expressed by, for example, $F(t)=G \cdot I(t)$ (G: proportionality coefficient) on the basis of the current I. The walking motion of an agent may be implemented on a treadmill.

Thereafter, it is determined whether the condition for terminating the operation, such as the operation switching having been switched from ON to OFF, an operational failure having been detected or the like, has been satisfied in STEP107 of FIG. 3. If the determination result is negative (NO in STEP107 of FIG. 3), then the aforesaid series of processing is repeated. If the determination result is positive (YES in STEP107 of FIG. 3), then the aforesaid series of processing is terminated.

(Estimating the Basic Frequency)

The processing for estimating the basic frequency $f_0$ by the basic frequency estimator 23 (refer to STEP103 of FIG. 3) will be described.

Figure 7:
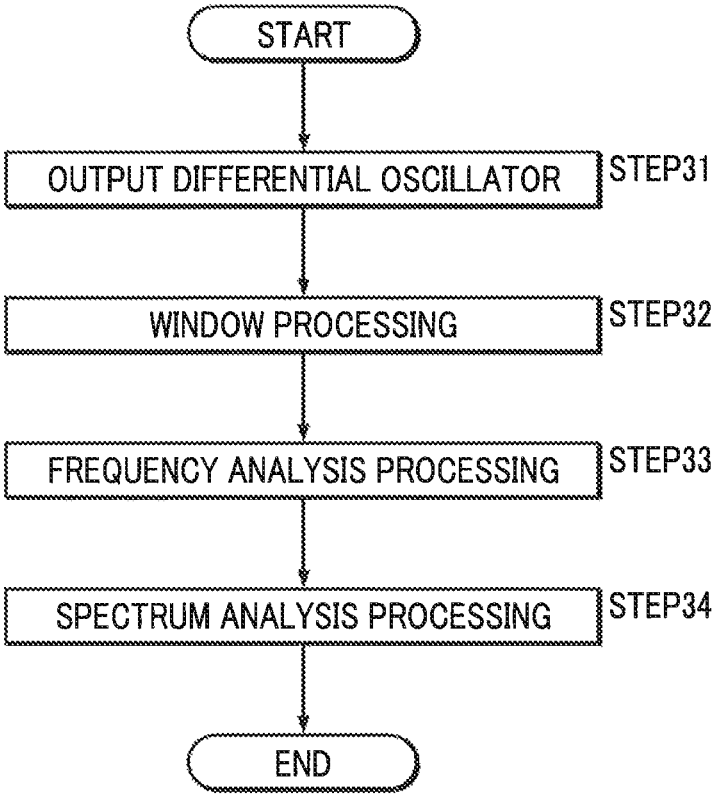
FIG. 7 is a flowchart illustrating the method for estimating a basic frequency.

First, the differential oscillator outputter 231 outputs, as a differential oscillator, a waveform signal indicative of the time-dependent change of the difference in the hip joint angle on the basis of the outputs of the right and left hip joint angle sensors 202R and 202L (STEP31 of FIG. 7). Thus, a waveform signal illustrated in FIG. 8(*a*) is obtained as a differential oscillator. Alternatively, a waveform signal indicative of the time-dependent change in the difference in the shoulder joint angle instead of the difference in the hip joint angle may be output as the differential oscillator.

Subsequently, the window processor 232 applies a window to the differential oscillator over a specified period of time (STEP32 of FIG. 7). A Hann window is used as the window function thereby to transform the differential oscillator over the specified period of time, which is indicated by the dashed line in FIG. 8(*b*), into the one indicated by the solid line. In addition to the Hann window, various other windows may be used as the window function, such as a rectangular window, a Gaussian window, a hamming window, a Blackman window, a Kaiser window, a Bartlett window, and an exponential window.

Based on a previous basic frequency $f_0(k-1)$ determined by the spectrum analysis processor 234, the window processor 232 sets a width w(k) of a current window according to a decreasing function which has the basic frequency $f_0$ as a variable. The decreasing function is defined by, for example, relational expression (050). Coefficients $w_{01}$ and $w_{02}$ are set to include at least two walking cycles. The window processor 232 adopts a constant that causes an initial window width w(0) to include at least two walking cycles.

$$w(k)=w_{01}/f_0(k-1)+w_{02} \tag{050}$$

The window processor 232 may downsample the differential oscillator (waveform signal) thereby to remove high-frequency components exceeding a first specified frequency from the differential oscillator before carrying out the window processing. The window processor 232 may pass the differential oscillator (waveform signal) through a high-pass filter to remove low-frequency components that are equal to or lower than a second specified frequency from the differential oscillator before carrying out the window processing.

The frequency analysis processor 233 carries out frequency analysis processing, such as FFT, on the windowed differential oscillator in the current specified period of time so as to create a power spectrum (STEP33 of FIG. 7). Thus, the power spectrum as illustrated in FIG. 8(*c*) is generated, the frequency f being indicated on the abscissa axis, while the power obtained by the frequency analysis being indicated on the ordinate axis.

The spectrum analysis processor 234 determines or estimates, as the basic frequency $f_0$, a frequency exhibiting a peak that is as high as or higher than a threshold value and positioned in a lowest frequency band (STEP34 of FIG. 7). To remove noises, the threshold value is set to a value in the range of 0.05 to 0.20 times the maximum peak value in the power spectrum. Thus, as illustrated in FIG. 8(*c*), the frequency exhibiting the position of a peak $P_1$ in the lowest frequency band out of peaks $P_1$ and $P_2$ that are as high as or higher than a threshold value $p_{th}$ is determined as the basic frequency $f_0$.

Figure 8:
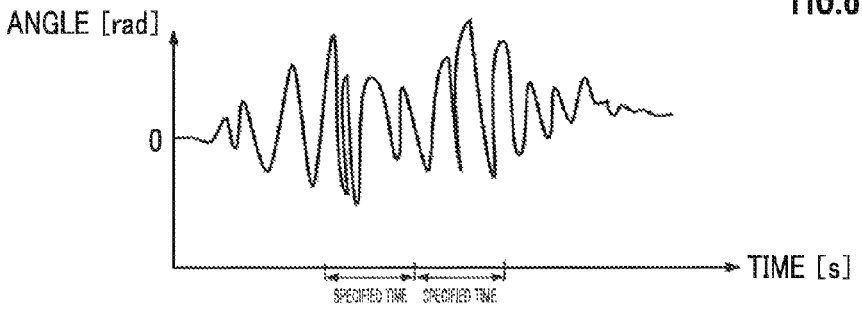
FIG. 8(*a*) to FIG. 8(*d*) are diagrams illustrating waveform signals, window processing, and a frequency analysis.
Figure 8:
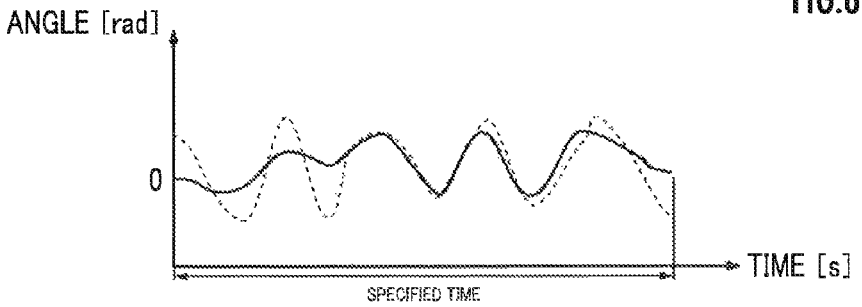
Figure 8:
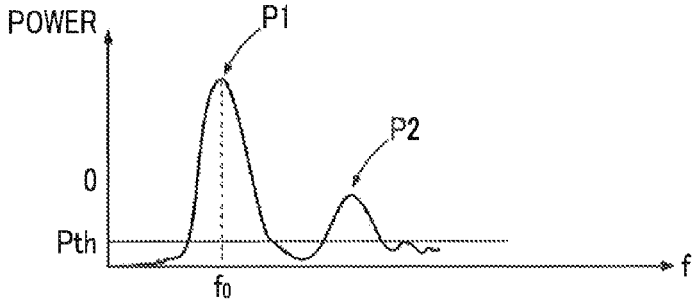
Figure 8:
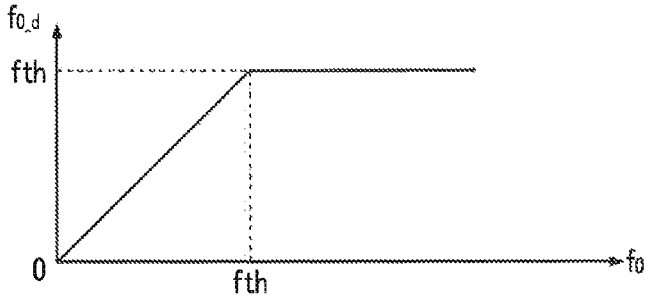

Further, the basic frequency $f_0$ is corrected according to relational expression (060), which denotes the slanting line given in FIG. 8(*d*), thereby determining a corrected basic frequency $f_{0_d}$.

$$f_{0_d}=f_0 \text{ (if } f_0 \leq f_{th}), f_{th} \text{ (if } f_0 > f_{th}) \tag{060}$$

Advantages of the Walking Assist Device

The First Embodiment

The walking assist device 10 as the first embodiment of the present invention displaying the functions described above indicate the degree of unevenness of the right and left motion patterns of a human being in the form of the degree of asymmetry s of the right and left motion oscillators $\phi_R$ and $\phi_L$ and reduces the degree of asymmetry s. This makes it possible to assist the walking motion of the human being by equalizing the right and left motion patterns of the human being.

For instance, in the situation wherein the length of stride of the left leg is smaller than the length of stride of the right leg, as illustrated in FIG. 4, the left control oscillator $\eta_L$ and the right control oscillator $\eta_R$, which change as illustrated in FIG. 5(*c*) are generated. The length of stride can be calculated according to a geometric relationship on the basis of the length of each thigh of the human being, who is the user, and the length of each crus, as necessary (stored in a memory), and the maximum values and the minimum values of the right and left hip joint angles indicated by the outputs of the hip joint angle sensors 202.

Therefore, if the right leg is in a standing state (when a foot is on a floor), then the amount of stepping forward of the left leg, which is free (with the foot thereof being off the floor) is increased, that is, the length of stride of the left leg, is increased. On the other hand, if the left leg is in the standing state, then the amount of stepping forward of the right leg, which is free, is kept unchanged or decreased, that is, the length of stride of the right leg is kept unchanged or decreased. As a result, the walking assist device 10 assists the walking motion such that the left leg is led to a larger length of stride for walking than the present length of stride, while the right leg is led to maintain the present length of stride or a smaller length of stride for walking, thus equalizing the lengths of stride and the walking rates of the right and left legs of the human being.

Further, the value of each coefficient $c_i$ is adjusted such that the left bending coefficient $c_{L+}$ and the right stretching coefficient $c_{R-}$ share the same value and the right bending coefficient $c_{R+}$ and the left stretching coefficient $c_{L-}$ share the same value (refer to relational expression (021)). This makes it possible to match or approximate the bending amplitude $|\chi_{L+}\xi_{L+}|$ of the left control oscillator and the stretching amplitude $|\chi_{R-}\xi_{R-}|$ of the right control oscillator $\eta_R$ and to match or approximate the bending amplitude $|\chi_{R+}\xi_{R+}|$ of the right control oscillator $\eta_R$ and the stretching amplitude $|\chi_{L-}\xi_{L-}|$ of the left control oscillator $\eta_L$ (refer to FIG. 5(*c*)). Hence, it is possible to obviate a situation in which the bending amount of a free leg is significantly unbalanced with the stretching amount of a standing leg, causing the human being, who is the user of the walking assist device 10, to feel uncomfortable.

Second Embodiment

The basic construction of a walking assist device 10 according to a second embodiment of the present invention is the same as the construction of the walking assist device 10 according to the first embodiment of the present invention (refer to FIG. 1).

Configuration of Controller

Second Embodiment

Figure 9:
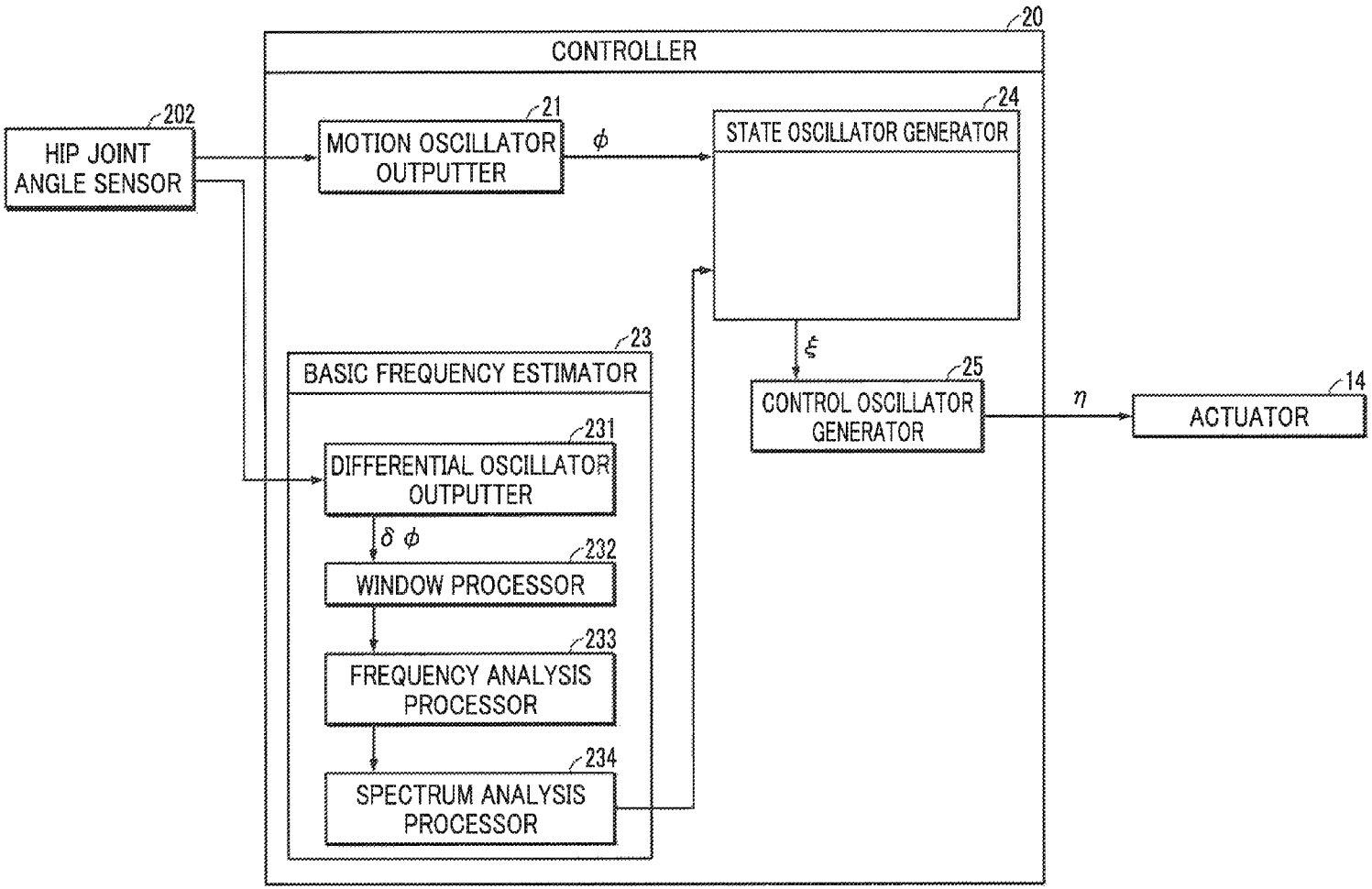
FIG. 9 is a block diagram of a control unit of a walking assist device (a second embodiment)

As illustrated in FIG. 9, a controller 20 in the second embodiment of the present invention differs from the controller 20 in the first embodiment in that the asymmetry evaluator 22 and the model adjustor 242 have been omitted, whereas the rest of the configuration is substantially the same as that of the controller 20 in the first embodiment of the present invention.

Functions of Walking Assist Device

Second Embodiment

Figure 10:
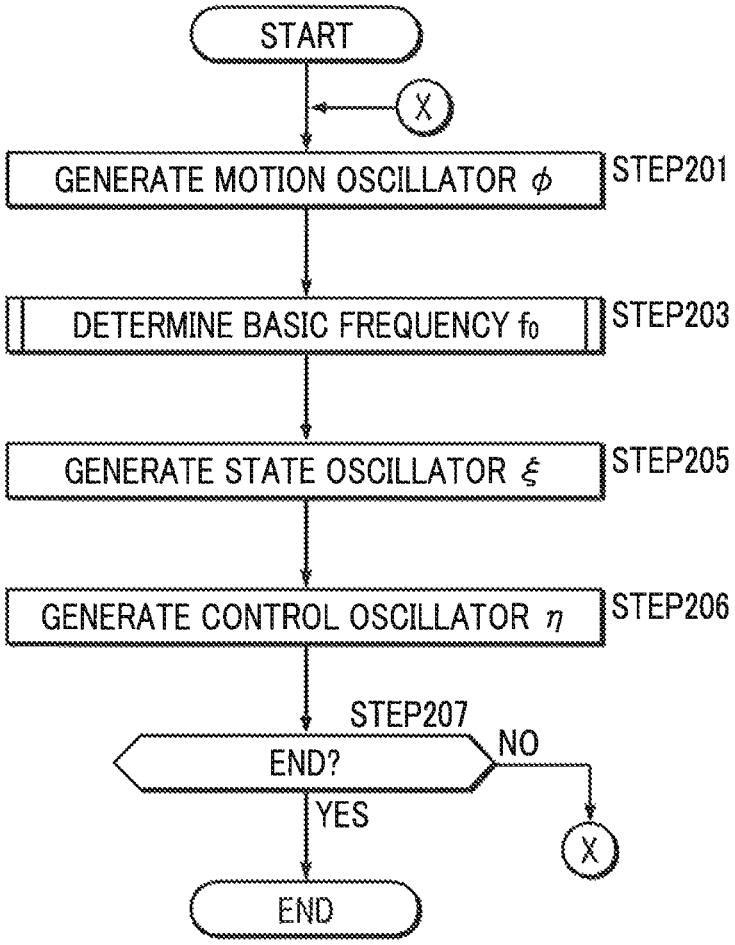
FIG. 10 is a flowchart illustrating a control method of the walking assist device (the second embodiment).

The walking assist device as the second embodiment of the present invention differs from the walking assist device as the first embodiment of the present invention in that the evaluation of the degree of asymmetry s (refer to STEP102 of FIG. 3) and the model adjustment (refer to STEP104 of FIG. 3) have been omitted, whereas the walking assist device as the second embodiment carries out the same processing as the processing in STEPs 101, 103 and 105 to 107 of FIG. 3 (STEPs 201, 203 and 205 to 207 of FIG. 10).

Advantages of Walking Assist Device Second Embodiment

The walking assist device 10 as the second embodiment of the present invention displaying the functions described above samples the difference between the right and left hip joint angles or shoulder joint angles of a human being to obtain a waveform signal (differential oscillator) (refer to STEP31 of FIG. 7 and FIG. 8(*a*)). Further, a power spectrum can be obtained from the waveform signal (refer to STEP33 of FIG. 7 and FIG. 8(*c*)). Thus, the walking state of the human being can be estimated with high accuracy according to the specific rule in which the basic frequency $f_0$ is referred to, the basic frequency $f_0$ exhibiting the position of a single peak that is as high as or higher than a threshold value in a power spectrum and lies in a lowest frequency band, regardless of the magnitude of the asymmetry of the right and left physical motions of the human being. The walking state is expressed by an estimated walking cycle, which is the inverse number of the basic frequency $f_0$, and alternatively expressed by any other state value, such as the length of stride or a walking rate, which can be calculated on the basis of the basic frequency $f_0$.

Further, the width w(k) of the current window to be applied to a waveform signal in a current specified period of time is set to be smaller as a previous basic frequency $f_0(k-1)$ is higher, whereas the width w(k) of the current window is set to be larger as the previous basic frequency $f_0(k-1)$ is lower. This makes it possible to extract a waveform signal having a just sufficient, appropriate width for a frequency analysis in estimating a current basic frequency $f_0(k)$ (refer to STEP32 of FIG. 7 and FIG. 8(*b*)).

Further, the walking assist device 10 assists the cyclic motion of each leg of a human being by the cyclic operations of the actuators 14 (refer to STEP206 of FIG. 10). At this time, the operations of the actuators 14 are determined on the basis of the basic frequency $f_0$ indicating an estimated walking state of the human being (refer to relational expressions (023) and (024)). This makes it possible to assist the walking motion of the human being at appropriate cycles according to the walking state of the human being, which is estimated with high accuracy on the basis of the basic frequency $f_0$ as described above.

Variations of the First Embodiment of the Present Invention

In place of the difference between the left total amplitude $|\phi_L|$ and a right total amplitude $|\phi_R|$, the difference between the left bending amplitude $|\phi_{L+}|$ and the right bending amplitude $|\phi_{R+}|$, the difference between the left stretching amplitude $|\phi_{L-}|$ and the right stretching amplitude $|\phi_{R-}|$, the difference between the sum of the left bending amplitude $|\phi_{L+}|$ and the right stretching amplitude $|\phi_{R-}|$ and the sum of the right bending amplitude $|\phi_{R+}|$ and the left stretching amplitude $|\phi_{L''}|$, or the mean value of the differences over a plurality of cycles may be evaluated as the degree of asymmetry s.

Only one or some of the left bending coefficient $c_{L+}$, the left stretching coefficient $c_{L-}$, the right bending coefficient $c_{R+}$, and the right stretching coefficient $c_{R-}$ may be corrected on the basis of a correction amount f(−s) or f(s) (refer to relational expressions (021) and (022)). For example, only the coefficients belonging to one of the pair of the left bending coefficient $c_{L+}$ and the right stretching coefficient $c_{R-}$ and the pair of the left stretching coefficient $c_{L-}$ and the right bending coefficient $c_{R+}$ may be increased or decreased on the basis of the correction amount f(s) to make an adjustment thereby to adjust the relative difference from the coefficients belonging to the other pair.

For the purpose of recovering a physical function, the length of stride of only one leg may be increased to equalize the lengths of strides of both legs. On the other hand, if the degree of asymmetry s is significantly high, then preferably, the length of stride of one leg is increased, while the length of stride of the other leg is decreased so as to equalize or approximate the lengths of strides of both legs. In this respect, it is determined whether the degree of asymmetry s exceeds a threshold value, and if the degree of asymmetry s is below the threshold value, then only the length of stride of one leg is increased to equalize the lengths of strides of both legs. If the degree of asymmetry s is the threshold value or more, then the lengths of strides of both legs may be approximated to each other.

The value of the coefficient D (refer to relational expression (022)) may be changed thereby to change the ratio between the correction amount f(−s) of the left bending coefficient $c_{L+}$ and the right stretching coefficient $c_{R-}$ and the correction amount f (s) of the left stretching coefficient $c_{L-}$ and the right bending coefficient $c_{R+}$. The coefficient D may be a function having "s" as a variable thereof.

Variations of the First and the Second Embodiments of the Present Invention

The configuration of the controller 20 is not limited to those of the embodiments described above as long as the controller

20 is adapted to control the magnitudes of the operation amplitudes of the actuators 14 for assisting the bending motion and the stretching motion of the left thigh of a human being and the bending motion and the stretching motion of the right thigh thereof on the basis of the magnitudes of the values of the left bending coefficient $c_{L+}$, the left stretching coefficient $c_{L-}$, the right bending coefficient $c_{R+}$, and the right stretching coefficient $c_{R-}$, respectively. The operation cycles of the actuators 14L and 14R may be controlled to match $2\pi/\omega_L$ and $2\pi/\omega_R$ according to specific angular velocities $\omega_L$ and $\omega_R$.

For example, the controller 20 may be adapted to set the values of the left bending coefficient $c_{L+}$, the left stretching coefficient $c_{L-}$, the right bending coefficient $c_{R+}$, and the right stretching coefficient $c_{R-}$ to a desired bending value of the left hip joint angle, a desired stretching value of the left hip joint angle, a desired bending value of the right hip joint angle, and the desired stretching value of the right hip joint angle, respectively, and to control the right and left hip joint angles according to a feedback control law, such as the PID control law. In this case, the motion oscillator outputter 21, the state oscillator generator 24, and the control oscillator generator 25 may be omitted. Alternatively, the basic frequency estimator 23 may be omitted.

As disclosed in publications of Japanese Patent No. 3930399, No. 3950149, No. 4008464, or No. 4271711, a first oscillator may be generated according to a first model defined by the Van der Pol equation or the like and the specific angular velocity $\omega$ (refer to simultaneous differential equation (010)) may be set on the basis of the first oscillator, and then the time constant $\tau_1$ may be set so as to be proportional to the inverse number of the specified angular velocity $\omega$. The second oscillator in the publications corresponds to the state oscillator in the present invention.

As described in the publication of Japanese Patent No 4271711, the control oscillator $\eta$ may be generated such that the control oscillator $\eta$ indicates one or both of an elastic force by a virtual elastic element and a damping force by a virtual damping element.

The basic frequency estimator 23 may be adapted to estimate, as the basic frequency $f_0$, the frequency of the left motion oscillator $\phi_L$, the frequency of the right motion oscillator $\phi_R$, the mean frequency of the frequency of the left motion oscillator $\phi_L$ and the frequency of the right motion oscillator $\phi_R$, or the mean value of the frequencies over a plurality of cycles.

What is claimed is:

1. A walking assist device, comprising:

a first attachment adapted to be attached to an upper body of a human being;

a pair of second attachments, each of which is adapted to be attached to right and left thighs, respectively, of the human being;

a pair of actuators;

a right hip joint angle sensor adapted to output a signal based on a right hip joint angle of the human being and a left hip joint angle sensor adapted to output a signal based on a left hip joint angle of the human being; and a control unit adapted to control an operation of each of the pair of actuators based on at least output signals of the right hip joint angle sensor and the left hip joint angle sensor, wherein each of the pair of the second attachments is moved relative to the first attachment by operating each of the pair of the actuators, thereby assisting a walking motion of the human being, which involves relative cyclic motions of the right and left thighs with respect to the upper body, the control unit is adapted to control a magnitude of movement amplitudes of the pair of the actuators for assisting each of a bending motion and a stretching motion of the right thigh and a bending motion and a stretching motion of the left thigh of the human being based on a magnitude of a value of each of a right bending coefficient, a right stretching coefficient, a left bending coefficient and a left stretching coefficient, and comprises:

an asymmetry evaluating unit adapted to evaluate a degree of asymmetry between a right motion oscillator, which is a waveform signal indicating the time-dependent change form of an output of the right hip joint angle sensor, and a left motion oscillator, which is a waveform signal indicating the time-dependent change form of an output of the left hip joint angle sensor, the degree of asymmetry being a difference between an amplitude of the left motion oscillator and an amplitude of the right motion oscillator; and an adjusting unit adapted to adjust the value of at least one of the right bending coefficient, the right stretching coefficient, the left bending coefficient and the left stretching coefficient so as to reduce the degree of asymmetry evaluated by the asymmetry evaluating unit, and such that the left bending coefficient and the right stretching coefficient become a same value, and the right bending coefficient and the left stretching coefficient become a same value.

2. The walking assist device according to claim 1, wherein the adjusting unit is adapted to adjust the value of at least one of the right bending coefficient, the right stretching coefficient, the left bending coefficient and the left stretching coefficient based on a correction amount defined by an increasing function having the degree of asymmetry as a variable.

3. The walking assist device according to claim 1, wherein the control unit is adapted to control levels of operating frequencies of the actuators for assisting the motions of the individual right and left thighs of the human being based on magnitudes of values of a right time constant and a left time constant, respectively, and the adjusting unit is adapted to adjust the values of the right time constant and the left time constant based on waveform signals indicating time-dependent change forms of the right and the left hip joint angles of the human being obtained from outputs of the right hip joint angle sensor and the left hip joint angle sensor, respectively.

4. The walking assist device according to claim 3, comprising:

a window processing unit adapted to carry out window processing for windowing a differential oscillator, which is a waveform signal obtained by sampling a difference between the right and left hip joint angles of the human being over a specified period of time, based on output signals of the right hip joint angle sensor and the left hip joint angle sensor, respectively;

a frequency analysis processing unit adapted to carry out a frequency analysis on the windowed differential oscillator thereby to acquire a power spectrum; and a spectrum analysis processing unit adapted to determine a basic frequency exhibiting a peak which has a height equal to or greater than a threshold value and which is positioned in a lowest frequency band of the power spectrum, wherein the adjusting unit adjusts the values of the right time constant and the left time constant such that the values are proportional to an inverse number of the basic frequency.

5. The walking assist device according to claim 1, wherein a difference in one of a bending amplitude indicative of an amplitude of a bending motion of a thigh relative to the upper body of the human being, a stretching amplitude indicative of an amplitude of a stretching motion of a thigh of the human being, and a total amplitude indicative of a sum of the bending amplitude and the stretching amplitude between the right motion oscillator and the left motion oscillator, or a mean value of differences over a plurality of cycles is evaluated as the degree of asymmetry.

6. The walking assist device according to claim 1, wherein the control unit comprises:

a state oscillator generating unit adapted to supply the right motion oscillator and the left motion oscillator as input waveform signals to a state oscillator model, which is defined by a simultaneous differential equation of a plurality of state variables indicating a bending motion state and a stretching motion state of each of the thighs of the human being, which is expressed by a time-dependent change form of a solution of the simultaneous differential equation determined based on the input waveform signals, and which generates output waveform signals, thereby to generate, as the output waveform signals, the right bending oscillator, the right stretching oscillator, the left bending oscillator and the left stretching oscillator, which change according to amplitudes based on the values of the right bending coefficient, the right stretching coefficient, the left bending coefficient, and the left stretching coefficient, respectively; and a control oscillator generating unit adapted to generate a right control oscillator serving as a control command signal for the actuator on the right side by combining the right bending oscillator and the right stretching oscillator and to generate a left control oscillator serving as a control command signal for the actuator on the left side by combining the left bending oscillator and the left stretching oscillator.

7. A walking assist device comprising:

a first attachment adapted to be attached to an upper body of a human being;

a pair of second attachments, each of which is adapted to be attached to right and left thighs, respectively, of the human being;

a pair of actuators;

a right hip joint angle sensor adapted to output a signal based on a right hip joint angle of the human being and a left hip joint angle sensor adapted to output a signal based on a left hip joint angle of the human being; and a control unit adapted to control the operation of each of the pair of actuators based on at least output signals of the right hip joint angle sensor and the left hip joint angle sensor, each of the pair of the second attachments being moved relative to the first attachment by operating each of the pair of the actuators, thereby assisting a walking motion of the human being, which involves relative cyclic motions of the right and left thighs with respect to the upper body, the walking assist device further comprising:

a walking state estimating device which determines a basic frequency by using a differential oscillator, which is a waveform signal obtained by sampling the difference between the right and left hip joint angles or shoulder joint angles of the human being through the right hip joint angle sensor and the left hip joint angle sensor over a specified period of time, wherein the control unit is adapted to control cyclic operations of the actuators based on a cycle established according to the basic frequency determined by the walking state estimating device, the walking state estimating device comprises:

a window processing unit adapted to execute window processing for windowing the differential oscillator;

a frequency analysis processing unit adapted to acquire a power spectrum by carrying out a frequency analysis on the windowed differential oscillator; and a spectrum analysis processing unit adapted to determine, as the basic frequency, a frequency exhibiting a peak which has a height equal to or greater than a threshold value and which is positioned in a lowest frequency band of the power spectrum, the window processing unit being adapted to set a width of a window of a current cycle according to a decreasing function, which has the basic frequency as a variable, based on a previous basic frequency determined by the spectrum analysis processing unit.

8. A walking assist method for assisting a walking motion of a human being, which involves relative cyclic motions of right and left thighs with respect to an upper body by moving each of a pair of second attachments adapted to be attached to the right and left thighs, respectively, of the human being in relation to a first attachment adapted to be attached to the upper body of the human being by operating each of a pair of actuators, the walking assist method comprising:

a step of controlling a magnitude of a motional amplitude of each of the pair of actuators for assisting a bending motion and a stretching motion of a right thigh of the human being and a bending motion and a stretching motion of a left thigh of the human being based on a magnitude of a value of each of a right bending coefficient, a right stretching coefficient, a left bending coefficient, and a left stretching coefficient;

a step of evaluating a degree of asymmetry between a right motion oscillator, which is a waveform signal indicating a time-dependent change form of a right hip joint angle of the human being, and a left motion oscillator, which is a waveform signal indicating a time-dependent change form of a left hip joint angle of the human being, the degree of asymmetry being a difference between an amplitude of the left motion oscillator and the right motion oscillator; and a step of adjusting the value of at least one of the right bending coefficient, the right stretching coefficient, the left bending coefficient, and the left stretching coefficient so as to reduce the degree of asymmetry, and such that the left bending coefficient and the right stretching coefficient become a same value, and the right bending coefficient and the left stretching coefficient become a same value.

9. A walking assist method for assisting a walking motion of a human being, which involves relative cyclic motions of right and left thighs with respect to an upper body by moving each of a pair of second attachments adapted to be attached to the right and left thighs, respectively, of the human being in relation to a first attachment adapted to be attached to the upper body of the human being by operating each of a pair of actuators, the walking assist method comprising:

a step of estimating a walking state, which determines a basic frequency, by using a differential oscillator, which is a waveform signal obtained by sampling a difference between right and left hip joint angles or shoulder joint angles of the human being over a specified period of time; and a step of controlling cyclic operations of the actuators according to a cycle established based on the basic frequency;

wherein the step of estimating a walking state includes:

a step of executing window processing for windowing the differential oscillator in the walking state estimating step;

a step of acquiring a power spectrum by carrying out a frequency analysis on the windowed differential oscillator; and a step of determining, as the basic frequency, a frequency exhibiting a peak which has a height equal to or greater than a threshold value and which is positioned in a lowest frequency band of the power spectrum, and wherein the window processing step is a step of setting a width of a window for a current cycle according to a decreasing function, which has the basic frequency as a variable, based on the basic frequency of a previous cycle.

10. A walking state estimating device comprising:

a window processing unit adapted to execute window processing for windowing a differential oscillator, which is a waveform signal obtained by sampling, over a specified period of time, the differences between right and left hip joint angles or shoulder joint angles of a human being while he or she is walking;

a frequency analysis processing unit adapted to acquire a power spectrum by carrying out a frequency analysis on the windowed differential oscillator; and a spectrum analysis processing unit adapted to determine a basic frequency exhibiting a peak which has a height equal to or greater than a threshold value and which is positioned in a lowest frequency band of the power spectrum, wherein the window processing unit is adapted to set a width of a window for a current cycle according to a decreasing function, which has the basic frequency as a variable, based on a basic frequency in a previous cycle determined by the spectrum analysis processing unit.

11. The walking state estimating device according to claim 10, wherein the window processing unit is adapted to remove high-frequency components exceeding a first specified frequency from the differential oscillator by downsampling the differential oscillator before carrying out the window processing.

12. The walking state estimating device according to claim 10, wherein the window processing unit is adapted to remove low-frequency components that are equal to or lower than a second specified frequency from the differential oscillator by passing the differential oscillator through a high-pass filter before carrying out the window processing.

13. A walking state estimating method, comprising:

a step of executing window processing for windowing a differential oscillator, which is a waveform signal obtained by sampling, over a specified period of time, differences between right and left hip joint angles or shoulder joint angles of a human being while he or she is walking;

a step of acquiring a power spectrum by carrying out a frequency analysis on the windowed differential oscillator; and a spectrum analysis processing step of determining a basic frequency exhibiting a peak which has a height equal to or greater than a threshold value and which is positioned in a lowest frequency band of the power spectrum, wherein the window processing step comprises a step of setting a width of a window for a current cycle according to a decreasing function, which has the basic frequency as a variable, based on a basic frequency in a previous cycle determined by the spectrum analysis processing step.

* * * * *